US005675984A

United States Patent [19]

Shin

[11] Patent Number: 5,675,984

[45] Date of Patent: Oct. 14, 1997

[54] AIR FLOW SYSTEM OF REFRIGERATOR

[75] Inventor: Jun-Chul Shin, Incheon, Rep. of Korea

[73] Assignee: Daewoo Electronics Co., Ltd., Seoul, Rep. of Korea

[21] Appl. No.: 714,335

[22] Filed: Sep. 18, 1996

[30] Foreign Application Priority Data

Sep. 18, 1995 [KR] Rep. of Korea ..... 95-30495

[51] Int. Cl.[6] ..... F25D 21/08

[52] U.S. Cl. ..... 62/276; 62/418

[58] Field of Search ..... 62/276, 413, 418, 62/441, 447

[56] References Cited

U.S. PATENT DOCUMENTS

| | | | |
|---|---|---|---|
| 2,918,834 | 11/1959 | Mann | 62/418 |
| 2,978,884 | 4/1961 | D'Aleandro et al. | 62/413 |
| 3,004,401 | 10/1961 | Mann et al. | 62/441 |
| 3,107,502 | 10/1963 | Herdon, Jr. et al. | 62/441 |
| 4,077,229 | 3/1978 | Gelbard et al. | 62/441 |
| 5,042,267 | 8/1991 | Beers et al. | 62/276 |
| 5,315,846 | 5/1994 | Lee | 62/418 |

*Primary Examiner*—William E. Tapolcai
*Attorney, Agent, or Firm*—Beveridge, DeGrandi, Weilacher & Young LLP

[57] ABSTRACT

A refrigerator having increased cooling efficiency is disclosed. A passage for the flow of the chilled air exhausted from a freezing compartment and a passage for the flow of the chilled air exhausted from a refrigerating compartment are separately formed. An attaching plate is installed near an evaporator in order to primarily cool and dehumidify the chilled air exhausted from the refrigerating compartment. The attaching plate is vertically installed and has a plurality of pores. A heat exchange between the chilled air from the refrigerating compartment and the attaching plate occurs. The humidity contained in the chilled air from the refrigerating compartment is transformed into frost attached to the attaching plate. The frost is transformed into water by a heater provided below an evaporator and the attaching plate and is exhausted outward.

6 Claims, 2 Drawing Sheets

AIR FLOW SYSTEM OF REFRIGERATOR

BACKGROUND OF THE INVENTION

1. Field of the Invention

The present invention relates to a refrigerator, and more particularly to a chilled air flow system of a refrigerator.

2. Description of the Prior Art

Generally, a refrigerator is an apparatus for storing various foodstuffs in either a frozen or a refrigerated condition to extend the freshness of the foodstuffs for a long time. Such a refrigerator includes two cooling sections, one of which is a direct cooling type. That is, an evaporator used in a refrigerating cycle is installed in a food storage space and a direct heat-exchange is effectively achieved. The other type of the cooling section is an indirect cooling type, that is, an evaporator is mounted in an air passage remote from the food storage space. The air is heat-exchanged by the evaporator, and then the heat-exchanged air is directed to the food storage space by a fan.

The above described refrigerator commonly is provided with a freezing compartment and a refrigerating compartment located below the freezing compartment. Further, the refrigerating compartment is provided with a separate space having a temperature different from that of the main refrigerating compartment. This separated compartment is called a "vegetable storage area" or a "chilled compartment" for storing meats, etc. In these spaces, the foodstuffs can be individually stored in accordance with the desired conditions. On the front face of both the freezing compartment and the refrigerating compartment doors are installed so that foodstuffs can be placed in or removed from the freezing compartment and the refrigerating compartment.

In the above-described refrigerator, in order to store the foodstuffs with the desired conditions, that is, in order to maintain each compartment at a predetermined temperature, the heat-exchanged chilled air is conducted into the inner portion of each compartment by the fan. The chilled air exhausted from the compartments flows along air passages.

The passages are disclosed in U.S. Pat. No. 4,704,874 issued to Thomson et al on Nov. 10, 1987 with the title of "Household refrigerator air flow system", in U.S. Pat. No. 5,388,427 issued to Sun G. Lee on Feb. 14, 1995 with the title of "Refrigerator with kimchi compartment" and in U.S. Pat. No. 5,433,086 issued to Cho et al on Jul. 18, 1995 and assigned to the assignee of the present invention with the title of "Refrigerator having independent temperature control of plural compartment".

FIG. 1 illustrates the conventional refrigerator disclosed in Thomson et at, Cho et al and Lee. As shown in the drawing, the conventional refrigerator includes a freezing compartment 10, a refrigerating compartment 30 which is separated from freezing compartment 10 by a partition 20 and located under freezing compartment 10, an evaporator 40 installed between freezing compartment 10 and an outer wall for cooling the air and removing the humidity contained in the air to generate a chilled air, a fan 50 positioned above evaporator 40 for directing the chilled air into freezing compartment 10 and refrigerating compartment 30, a main air duct 60 formed between evaporator 40 and the outer wall for providing a passage for the chilled air into refrigerating compartment 30 by fan 50, a first air duct 62 formed between freezing compartment 10 and partition 30 for the exhausting chilled air to flow from freezing compartment 10 to evaporator 40, a second air duct 64 formed between partition 20 and refrigerating compartment 30 for conducting the exhausting chilled air from refrigerator 30 to evaporator 40, and a third air duct 66, in which the chilled air having respectively flown along first duct 62 and second duct 64 is mixed, for providing a passage for the mixed chilled air to flow toward evaporator 40.

The chilled air generated by evaporator 40 is directed into freezing compartment 10 and refrigerating compartment 30 by fan 50. The chilled air cools freezing and refrigerating compartments 10 and 30, and then flows to first air duct 62 through a first chilled air outlet 12 formed at the bottom portion of freezing compartment 10. Meanwhile, the chilled air conducted into refrigerating compartment 30 cools refrigerating compartment 30 and flows to second air duct 64 through a second chilled air outlet 32 formed at the upper portion of refrigerating compartment 30. The chilled airs from first and second air ducts 62 and 64 are mixed at third air duct 66 and the chilled air flows into evaporator 40 to be cooled again by evaporator 40. At this time, the humidity contained in the air is transformed into a layer of frost attached to evaporator 40. The layer of frost is transformed into water by a heater 68 installed in third air duct 66 and then the water is exhausted through a water outlet 69 formed at the bottom portion of third air duct 66.

The structure of the freezing compartment and the refrigerating compartment of the refrigerator for circulating the chilled air will be described briefly with reference to FIG. 1 below.

In the above-described refrigerator, the chilled air generated by evaporator 40 is circulated in the inner portions of freezing compartment 10 and refrigerating compartment 30, first, second and third air ducts 62, 64 and 66, and evaporator 40 by fan 50 to cool freezing compartment 10 and refrigerating compartment 30. Particularly, when cooling freezing compartment 10, the chilled air is directed into freezing compartment 10 by fan 50 through a chilled air inlet 14 formed at the rear portion of the freezing compartment. After cooling the inner portion of freezing compartment 10, the chilled air is exhausted from freezing compartment 10 through first chilled air outlet 12. The exhausted air flows along first air duct 62 and third air duct 66 to evaporator 40 and cooled again by evaporator 40.

For cooling refrigerating compartment 30, the chilled air is directed into refrigerating compartment 30 through main duct 60 by fan 50 and is exhausted from refrigerating compartment 30 through second outlet 32. The exhausted chilled air from refrigerating compartment 30 flows along second air duct 64 formed between partition 20 and refrigerating compartment 30 and then is mixed with the chilled air exhausted from freezing compartment 10 at third air duct 66. The temperature and the humidity of the chilled air exhausted from refrigerating compartment 30 are higher than those of the chilled air from freezing compartment 10. A portion of the humidity contained in the chilled air exhausted from refrigerating compartment 30 is removed as it attaches on the bottom portion of partition 20 as a layer of frost. The frost is transformed into water by a heater wire (not shown) for heating partition 20, and the water is exhausted through water outlet 69 formed at the bottom portion of third air duct 66.

Accordingly, the chilled air passed through freezing compartment 10 and the chilled air passed through refrigerating compartment 30 are mixed at third air duct 66 and then the chilled air is cooled by evaporator 40. The humidity contained in the mixed chilled air is transformed into a layer of frost attached to evaporator 40. The frost attached to evaporator 40 is transformed into water by heater 68 and the water is exhausted out through water outlet 69 formed at the bottom portion of third air duct 66.

However, since partition 20 is formed nearly horizontally, the contacting distance and the contacting time of the chilled air exhausted from refrigerating compartment 30 with partition 20 are short. Accordingly, the humidity attaching efficiency of partition 20 is low and the dehumidifying efficiency of evaporator 40 is low. Further, since partition 20 is formed horizontally, when the frost is transformed into water, the flowing velocity of the water to water outlet 69 is slow and the exhausting efficiency through water outlet 69 is low.

SUMMARY OF THE INVENTION

Accordingly, it is an object of the present invention to provide a refrigerator comprising an evaporator having an increased cooling efficiency by effectively removing the humidity contained in the chilled air exhausted from a refrigerating compartment.

To accomplish the object of the present invention, there is provided a refrigerator comprising:

a freezing compartment;

a refrigerating compartment positioned below the freezing compartment with a predetermined distance;

an evaporator installed between the freezing compartment and an outer wall, for cooling air to generate a chilled air;

a fan for directing the chilled air generated from the evaporator into the freezing compartment and the refrigerating compartment;

an intermediate wall positioned between the outer wall and the evaporator, for forming a main air duct for conducting the chilled air provided by the fan;

a first air duct formed between the freezing compartment and the refrigerating compartment, for the chilled air from the freezing compartment to be exhausted, the first air duct forming a second air duct with the refrigerating compartment, for the chilled air from the refrigerating compartment to be exhausted;

an inner wall installed between the intermediate wall and the evaporator, for forming a third air duct which is connected with the second air duct;

a porous attaching plate installed between the inner wall and the evaporator with a predetermined distance, for cooling the chilled air passed through the second air duct and the third air duct and for transforming humidity in the chilled air into a layer of frost attached to the attaching plate, the porous attaching plate being formed from a metal; and a heater positioned below the evaporator, for transforming the layer of frost attached to the evaporator and the attaching plate into water to remove the layer of frost attached to the evaporator and the attaching plate.

The attaching plate is made from a metal and is installed vertically near the evaporator. A plurality of pores are formed in the attaching plate to pass the chilled air. The surface temperature of the attaching plate is lower than the temperature of the chilled air exhausted from the refrigerating compartment. When the chilled air passes through the pores in the attaching plate, heat exchange between the chilled air and the attaching plate is achieved. At this time, the humidity contained in the chilled air attaches to the attaching plate in the form of a layer of frost.

At the leading edge of the first air duct, a first outlet for exhausting the chilled air from the freezing compartment and a second outlet for exhausting the chilled air from the refrigerating compartment are formed. The water generated by the heater is exhausted out of the refrigerator through a water outlet.

In the first air duct, the chilled air exhausted from the freezing compartment is conducted toward the evaporator. Meanwhile, the chilled air exhausted from the refrigerating compartment is exhausted through the second outlet, is conducted along the second air duct and the third air duct and then passes through the attaching plate toward the evaporator.

The chilled air exhausted from the refrigerating compartment is directed along the second outlet, the second air duct and the third air duct. Then the heat exchange between the chilled air and the attaching plate occurs. At this time, the temperature of the chilled air exhausted from the refrigerator is lowered and the humidity contained in the chilled air is transformed into a layer of frost attached to the attaching plate. The attached frost on the attaching plate is transformed into water by the heater and the water is exhausted out through the water outlet. The chilled air from the attaching plate is cooled again by the evaporator and is directed to the freezing compartment and the refrigerating compartment by the fan.

In the refrigerator according to the present invention, the chilled air exhausted from the freezing compartment and the chilled air exhausted from the refrigerating compartment are respectively directed along separate passages and are cooled again by the evaporator. By installing the attaching plate vertically near the evaporator, the chilled air from the refrigerating compartment, whose temperature and humidity are higher than those of the chilled air from the freezing compartment, can be effectively cooled and dehumidified.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Hereinafter, the constituting elements and the operation principles of the refrigerator according to an embodiment of the present invention will be explained in more detail with reference to the accompanying drawings.

Figure 1:
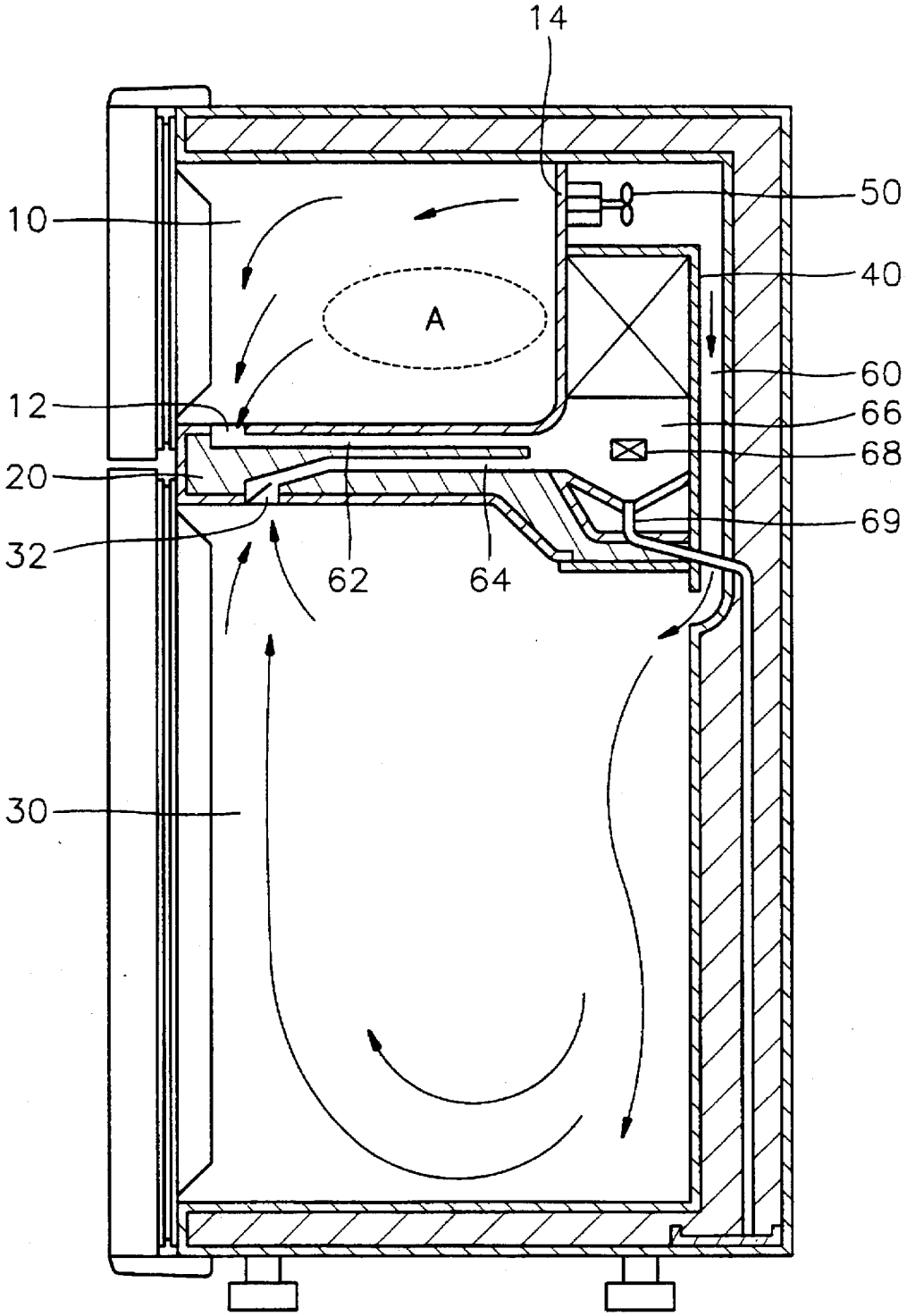
FIG. 1 (PRIOR ART)
FIG. 1 is a cross-sectional view of the conventional refrigerator for showing the circulation system of a chilled air.
Figure 2:
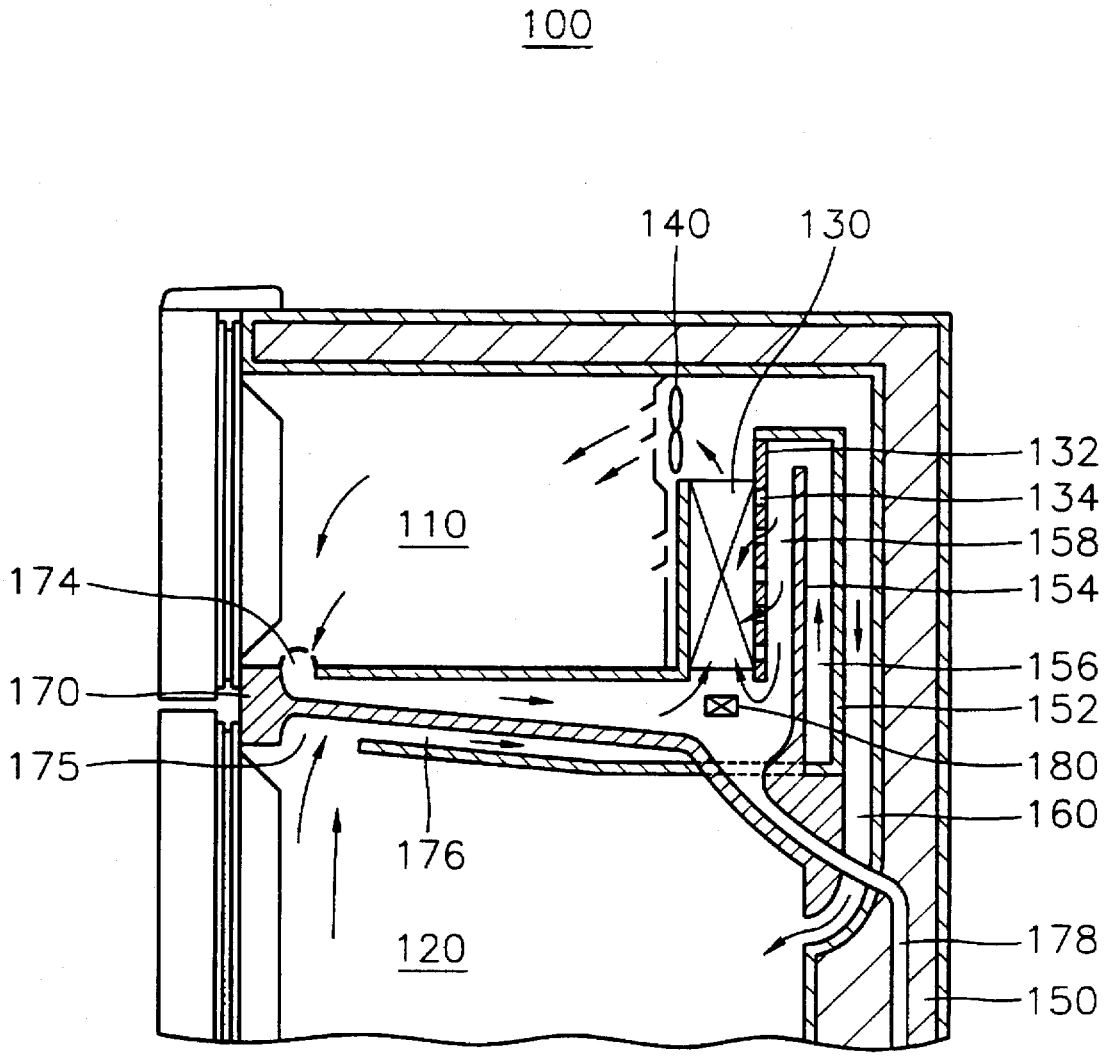
FIG. 2 is a cross-sectional view of a refrigerator according to the present invention for showing the circulation system of a chilled air.

A refrigerator 100 according to a preferred embodiment of the present invention, as illustrated in FIG. 2, is provided with a freezing compartment 110, a refrigerating compartment 120 positioned below freezing compartment 110 with a predetermined distance, an evaporator 130 positioned between an outer wall 150 and freezing compartment 110, for generating a chilled air by cooling air, and a fan for providing the chilled air generated by evaporator 130 into freezing compartment 110 and refrigerating compartment 120.

An intermediate wall 152 is formed between outer wall 150 and evaporator 130. Outer wall 150 and intermediate wall 152 provide a main duct 160 which forms a passageway for the chilled air directed into refrigerating compartment 120 by fan 140 to flow. Main duct 160 is connected with refrigerating compartment 120.

A first air duct 170 is provided between freezing compartment 110 and refrigerating compartment 120. At the leading edge of first air duct 170, a first chilled air outlet 174 for exhausting the chilled air from freezing compartment 110 and a second chilled air outlet 175 for exhausting the chilled air from refrigerating compartment 120 are formed. The cross-sectional area of first air duct 170 increases along the length thereof. A second air duct 176 is formed between first air duct 170 and refrigerating compartment 120, for the chilled air exhausted from refrigerating compartment 120 to flow.

An inner wall 154 is installed between intermediate wall 152 and evaporator 130. Inner wall 154 is vertically connected with the end portion of first air duct 170 and forms a water outlet 178 with the end portion of first air duct 170. Inner wall 154 also forms a third air duct 156 which is connected with second air duct 176 with intermediate wall 152.

An attaching plate is vertically installed between inner wall 154 and evaporator 130 with a predetermined distance from inner wall 154. In attaching plate 132, a plurality of pores 134 are formed. Attaching plate 132 is made from a metal, preferably from aluminum. The chilled air conducted along third air duct 156 is directed along a space 158 formed between attaching plate 132 and inner wall 154. A portion of the chilled air in space 158 passes through pores 134 of attaching plate 132 toward evaporator 130. The remaining chilled air is mixed with the chilled air exhausted from refrigerating compartment 110 and directed along first air duct 170, and the mixed air is directed toward evaporator 130. The chilled air passed through pores 134 of attaching plate 132 and directed toward evaporator 130 is primarily cooled through a heat exchange with attaching plate 132 and then is secondarily cooled by evaporator 130. The humidity contained in the chilled air passing through attaching plate 132 is transformed into frost attached to attaching plate 132.

A heater 180 is provided between evaporator 130 and water outlet 178. The frost attached to evaporator 130 and attaching plate 132 is transformed into water by heater 180. The phase changed water from the frost by heater 180 is drained off through water outlet 178.

The operation of refrigerator 100 according to a preferred embodiment of the present invention will be described below.

First, the chilled air generated by evaporator 130 is directed into freezing compartment 110 and refrigerating compartment 120 by fan 140. The chilled air provided into refrigerating compartment 120 is directed into refrigerating compartment 120 via main air duct 160.

The chilled airs in freezing compartment 110 and refrigerating compartment 120 are exhausted through first air duct 170 and second air duct 176, respectively, after cooling the inner portions of the compartments. The chilled air exhausted from freezing compartment 110 is directed toward evaporator 130 through first air duct 170, and the chilled air exhausted from refrigerating compartment 120 is directed toward evaporator 130 through second air duct 176, third air duct 156 and space 158 formed between attaching plate 132 and inner wall 154.

A portion of the chilled air provided from space 158 formed between attaching plate 132 and inner wall 154 passes through the plurality of pores 134 formed in attaching plate 132 and is primarily cooled through the heat exchange phenomenon with attaching plate 132. The remaining portion of the chilled air is mixed with the chilled air provided from first air duct 170 and the mixed air is cooled by evaporator 130. At this time, the humidity contained in the chilled air is transformed into frost attached to attaching plate 132 and evaporator 130. The frost is transformed into water by heater 180 installed below evaporator 130 and then the water is drained off through water outlet 178.

In the refrigerator according to the present invention, separate ducts are provided for the chilled air exhausted from the freezing compartment and for the chilled air exhausted from the refrigerating compartment to effectively cool and dehumidify the chilled airs. Further, the frost and water obtained when primarily cooling the chilled air exhausted from the refrigerating compartment can be advantageously removed by providing the attaching plate vertically.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a freezing compartment;

a refrigerating compartment positioned below said freezing compartment with a predetermined distance;

an evaporator installed between said freezing compartment and an outer wall, for cooling air to generate a chilled air;

a fan for directing said chilled air generated from said evaporator into said freezing compartment and said refrigerating compartment;

an intermediate wall positioned between said outer wall and said evaporator, for forming a main air duct for conducting said chilled air provided by said fan;

a first air duct formed between said freezing compartment and said refrigerating compartment, for said chilled air from said freezing compartment to be exhausted, said first air duct forming a second air duct with said refrigerating compartment, for said chilled air from said refrigerating compartment to be exhausted;

an inner wall installed between said intermediate wall and said evaporator, for forming a third air duct which is connected with said second air duct;

a porous attaching plate installed between said inner wall and said evaporator with a predetermined distance, for cooling said chilled air passed through said second air duct and said third air duct and for transforming humidity in said chilled air into a layer of frost attached to said attaching plate, said porous attaching plate being formed from a metal; and a heater positioned below said evaporator, for transforming said layer of frost attached to said evaporator and said attaching plate into water to remove said layer of frost attached to said evaporator and said attaching plate.

2. A refrigerator as claimed in claim 1, wherein a cross-sectional area of said first air duct increases along a length thereof.

3. A refrigerator as claimed in claim 1, wherein said first air duct is made from an insulating material.

4. A refrigerator as claimed in claim 1, wherein said attaching plate is made from aluminum.

5. A refrigerator as claimed in claim 1, wherein said attaching plate is installed vertically.

6. A refrigerator comprising:

a freezing compartment;

a refrigerating compartment positioned below said freezing compartment with a predetermined distance;

an evaporator installed between said freezing compartment and an outer wall, for cooling air to generate a chilled air;

a fan for directing said chilled air generated from said evaporator into said freezing compartment and said refrigerating compartment;

an intermediate wall positioned between said outer wall and said evaporator, for forming a main air duct for conducting said chilled air provided by said fan;

a first air duct made from an insulating material and formed between said freezing compartment and said refrigerating compartment, for said chilled air from said freezing compartment to be exhausted, a cross-sectional area of said first air duct increasing along a length thereof, and said first air duct forming a second air duct with said refrigerating compartment, for said chilled air from said refrigerating compartment to be exhausted;

an inner wall installed between said intermediate wall and said evaporator, for forming a third air duct which is connected with said second air duct;

a porous attaching plate made from aluminum and installed vertically between said inner wall and said evaporator with a predetermined distance, for cooling said chilled air passed through said second air duct and said third air duct and for transforming humidity in said chilled air into a layer of frost attached to said attaching plate, said porous attaching plate being formed from a metal; and a heater positioned below said evaporator, for transforming said layer of frost attached to said evaporator and said attaching plate into water to remove said layer of frost attached to said evaporator and said attaching plate.

* * * * *